US010589887B2

(12) United States Patent
Mayrpeter et al.

(10) Patent No.: US 10,589,887 B2
(45) Date of Patent: Mar. 17, 2020

(54) FILLING DEVICE

(71) Applicant: OMP TRADE GMBH, Sierning (AT)

(72) Inventors: Johannes Mayrpeter, Sierning (AT); Norbert Obermayr, Sierning (AT)

(73) Assignee: OMP Trade GmbH, Sierning (AT)

( * ) Notice: Subject to any disclaimer, the term of this patent is extended or adjusted under 35 U.S.C. 154(b) by 0 days.

(21) Appl. No.: 16/316,421

(22) PCT Filed: Jul. 11, 2017

(86) PCT No.: PCT/AT2017/060173
§ 371 (c)(1),
(2) Date: Jan. 9, 2019

(87) PCT Pub. No.: WO2018/009952
PCT Pub. Date: Jan. 18, 2018

(65) Prior Publication Data

US 2019/0233154 A1 Aug. 1, 2019

(30) Foreign Application Priority Data

Jul. 12, 2016 (AT) ..... A 50617/2016
Feb. 27, 2017 (AT) ..... A 50155/2017

(51) Int. Cl.
*B65B 69/00* (2006.01)

(52) U.S. Cl.
CPC ..... *B65B 69/0075* (2013.01); *B65B 69/0041* (2013.01); *B65B 69/0083* (2013.01)

(58) Field of Classification Search
CPC ..... B65B 69/0075; B65B 69/0041; B65B 69/0083
See application file for complete search history.

(56) References Cited

U.S. PATENT DOCUMENTS 4,049,157 A * 9/1977 Carson ..... A47G 19/32 222/81
4,527,716 A * 7/1985 Haas ..... B65B 69/0091 222/105

(Continued)

FOREIGN PATENT DOCUMENTS

DE 602004001709 T2 10/2007
DE 102006057760 B3 7/2008

(Continued)

OTHER PUBLICATIONS

International Search Report and Written Opinion Received in PCT/AT2017/060173 dated Oct. 20, 2017, pp. 12.

*Primary Examiner* — Frederick C Nicolas
(74) *Attorney, Agent, or Firm* — Liang & Hennessey; Brian E. Hennessey

(57) ABSTRACT

A filling device for decanting material from a flexible bulk material container is provided. The filling device has a hollow body that has an upper opening face and a lower opening face. The upper end of the hollow body projects into the interior of the flexible bulk material container so that material from the flexible bulk material container can enter the hollow body via the upper opening face. At the lower end of the hollow body there is a closure that has an upper plate and a lower plate. The lower plate can be pivoted about the axis of a bolt from a first position in which it completely closes the opening of the upper plate to a second position in which the opening of the upper plate is at least slightly open. The lower plate has a structure that forms at least part of the standing face.

20 Claims, 7 Drawing Sheets

(56) References Cited

U.S. PATENT DOCUMENTS

| | | | | | |
|---|---|---|---|---|---|
| 4,871,359 | A * | 10/1989 | Sjonell | A61M 5/162 604/411 |
| 5,405,053 | A * | 4/1995 | Zublin | B65B 69/0041 141/330 |
| 8,770,441 | B2 * | 7/2014 | Macler | B65D 33/01 222/85 |

FOREIGN PATENT DOCUMENTS

| | | | |
|---|---|---|---|
| EP | 2937291 | A1 | 10/2015 |
| FR | 2895728 | A3 | 7/2007 |

* cited by examiner

FILLING DEVICE

CROSS-REFERENCE TO RELATED APPLICATIONS

This application is a national phase application of PCT Application No. PCT/AT2017/060173, filed Jul. 11, 2017, entitled "FILLING DEVICE", which claims priority to Austrian Patent Application No. A 50155/2017, dated Feb. 27, 2017, and Austrian Patent Application No. A 50617/2016, dated Jul. 12, 20167, all of which are incorporated by reference in their entirety.

FIELD OF THE INVENTION

The invention relates to a closable filling device for the filling of bulk materials from flexible bulk material containers, in particular a filling mandrel.

DESCRIPTION OF RELATED ART

A flexible bulk material container is a large sack made of fabric or woven plastics, which is known by the term big bag. To quickly completely empty the big bag, it is normally lifted, and its base surface is cut with a knife. To be able to meter the emptying, filling devices in the form of a mandrel are known, which pierce the woven plastics from below with their tip, such that the tip penetrates the bulk material. The bulk material can be emptied from the flexible bulk material container into the filling device through openings, wherein the filling device comprises a closing mechanism to enable the emptying to be started and stopped.

FR2895728A3 discloses a filling device in the form of a filling mandrel for big bags. The filling mandrel has a cylindrical hollow body, at the upper end of which a number of struts merge into a tip. At a distance from the struts, the filling mandrel features barbs, which protrude from the cylindrical hollow body. Above the barbs, the cylindrical hollow body features openings. At the lower end, the cylindrical hollow body features a closure, which is formed from two discs one on top of the other, wherein the upper plate is firmly connected to the cylindrical hollow body and features a central opening and the lower plate is designed as a complete plate and is pivotably fixed to the upper plate by means of a threaded bolt. The filling mandrel pierces the big bag by the tip, until the barbs penetrate the big bag. Then the filling mandrel is retracted slightly, such that the barbs rest against the fabric of the big bag from the inside. Bulk materials can now penetrate the cylindrical hollow body between the struts and through the openings above the barbs. By pivoting the lower plate about the threaded bolt, the closure is opened, and the bulk material descends through the cylindrical hollow body. Both discs are provided with handles in order to enable the pivoting motion to be performed by hand.

The mounting of the lower plate on the threaded bolt is disadvantageous, as the nut or the head of the threaded bolt projects downwards from the lower plate and consequently the filling mandrel does not sit flush on the ground. In addition, it is disadvantageous that, when the closure is closed, the lower plate is only held on the threaded bolt and consequently the weight force of the bulk material exerts a strong momentum on the disc, whereby the plate end opposite the threaded bolt is pressed downwards, which results in a considerable strain on or even deformation of the lower disc. Alternatively, the known closures are not sufficiently sealed due to the inadequate support in the case of fine bulk materials such as sand or salt.

EP 2937291 A1 discloses an extension of the device of FR 2895728 A3 to include a filling nozzle, which can be screwed to the upper plate from below as necessary, when the filling mandrel has already pierced. Otherwise, the devices are identical, although neither the filling mandrel nor the filling nozzle features a satisfactory base.

In practice, the aforementioned devices are used by placing them with the lower plate of the closure on the ground and lowering the flexible bulk material container or big bag from above onto the filling mandrel. The protruding bolts mean no level position is provided. By lowering the big bag, strong forces are exerted on the filling mandrel, which can lead to one of the handles, usually that of the upper disc, breaking off. In addition, there is the problem that when lifting the big bag including the mandrel the lower plate can be pushed downwards away from the upper disc, such that bulk material can unintentionally escape, or adverse high momentums can be effected on the bolt and the lower disc, which can lead to damage. In addition, full or partially emptied flexible bulk material containers or big bags are often placed on the ground with the filling devices still inserted, wherein the known filling devices are only moderately suitable for this and whereby increased damage can occur. This is also the case with the known filling devices of reusable big bags or flexible reusable bulk material containers.

SUMMARY OF THE INVENTION

The object of the invention is to improve filling devices for flexible bulk material containers, such that the aforementioned damage is avoided.

To achieve the object, a filling device is proposed for the filling of material from a flexible bulk material container, which device features a hollow body having an upper and a lower opening surface, wherein the upper end of the hollow body protrudes into the interior of the flexible bulk material container, such that material can exit the flexible bulk material container and penetrate said hollow body through the upper opening surface thereof, wherein at the lower end of the hollow body a closure is provided featuring an upper plate and a lower plate lying flatly against each other, wherein the upper plate connects to the lower opening surface of the hollow body and the upper plate itself has an opening in the extension of the lower opening surface of the hollow body and wherein the lower plate is fixed by a bolt to the upper plate and the lower plate can be pivoted about the axis of this bolt, between a first position, in which it completely closes the opening of the upper disc, and a second position, in which the opening of the upper plate is at least partially opened, wherein the lower plate features a structure, which forms at least a part of the base of the filling device, wherein the bolt or its head or the nut of the bolt does not protrude downwards from the base.

A preferred improvement according to the invention is that at least one of the handles is fixed pivotably to the respective disc, such that this can be folded away in the upwards direction. Should an excessive momentum be exerted on the handle when lowering the flexible bulk material container, said handle folds upwards before damage can occur.

The upper plate preferably has an at least approximately square perimeter, wherein, in the closed state of the filling device, the lower plate covers at least the lower opening surface of the upper plate and the corner regions of its at least approximately square perimeter and the lower plate is provided, at least in these corner regions, with the structure which forms the base and/or four support legs of the filling device.

It is preferably proposed that the lower plate and the upper plate of the filling device be provided with a structure, such that both discs form a shared lower surface on which the filling device stands, wherein the head or the nut of the bolt of the pivoting mechanism does not protrude beyond this shared lower surface of the upper and lower plate and the upper plate or its handle has at least one locking projection positioned at a distance from the contact surface with the lower disc, wherein the lower plate is held in the closed state between this locking projection and the contact surface.

At least two locking projections are preferably provided, which hold the lower plate to the upper plate in the closed state. These locking projections preferably each have an angle of at least 90° to 135° to each other and to the bolt (e.g. an angle of 120° in each case or one of 90° and two of 135°), relating to the centre point of the opening of the hollow body, such that the lower plate is held in the closed position at three separated points distributed over the circumference of the opening.

A handle is preferably attached respectively to the upper plate and the lower disc, said handles each extending approximately horizontally from the respective disc, wherein the lower surface of each handle does not protrude downwards beyond the base of the filling device.

The measure according to the invention of fixing at least one of the levers or handles pivotably to the respective disc, such that it can be folded away in the upwards direction, can also be implemented independently of the other improvements according to the invention, such that the filling device known from prior art is only improved by at least one folding handle. In this case, the above-described first solution according to the invention of the improved base can naturally also be provided in order to further improve the filling device.

BRIEF DESCRIPTION OF THE DRAWINGS

The invention is illustrated on the basis of drawings.

DETAILED DESCRIPTION

FIGS. 1 to 4 all show the same particularly preferable filling mandrel 1 according to the invention. The filling mandrel 1 features a hollow body 2, which preferably has a cylindrical jacket. On the upper end of the hollow body 2, a number of struts 3 merge into a tip. For reasons of stability and due to the preferred production using plastic injection moulding, four struts 3, distributed uniformly over the circumference of the cylinder, have emerged as the technically best variation, as three struts 3 would require a very complex injection mould. At the lower end, the hollow body 2 merges into the upper plate 4, which connects to the cylinder on the outside and preferably leaves the inner opening of the hollow body 2 entirely open. The hollow body 2, the upper plate 4 and the struts 3 forming the tip are preferably produced as monolithic plastics bodies using the injection moulding procedure.

Figure 1:
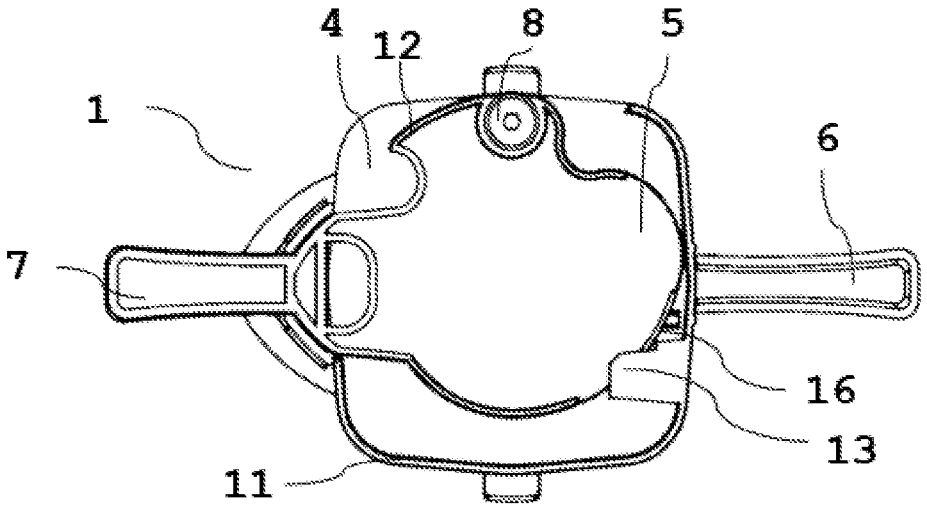
FIG. 1: shows the filling mandrel according to the invention in a view from below with a closed closure.
Figure 2:
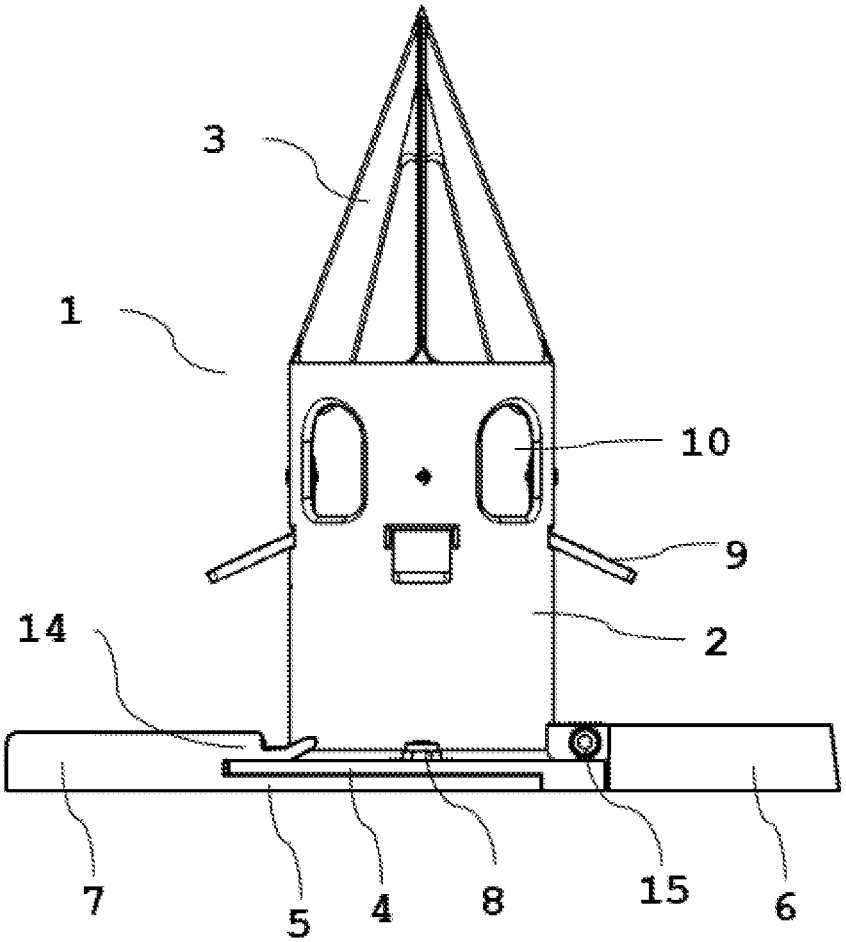
FIG. 2: shows the filling mandrel according to the invention in a front view with a closed closure.
Figure 3:
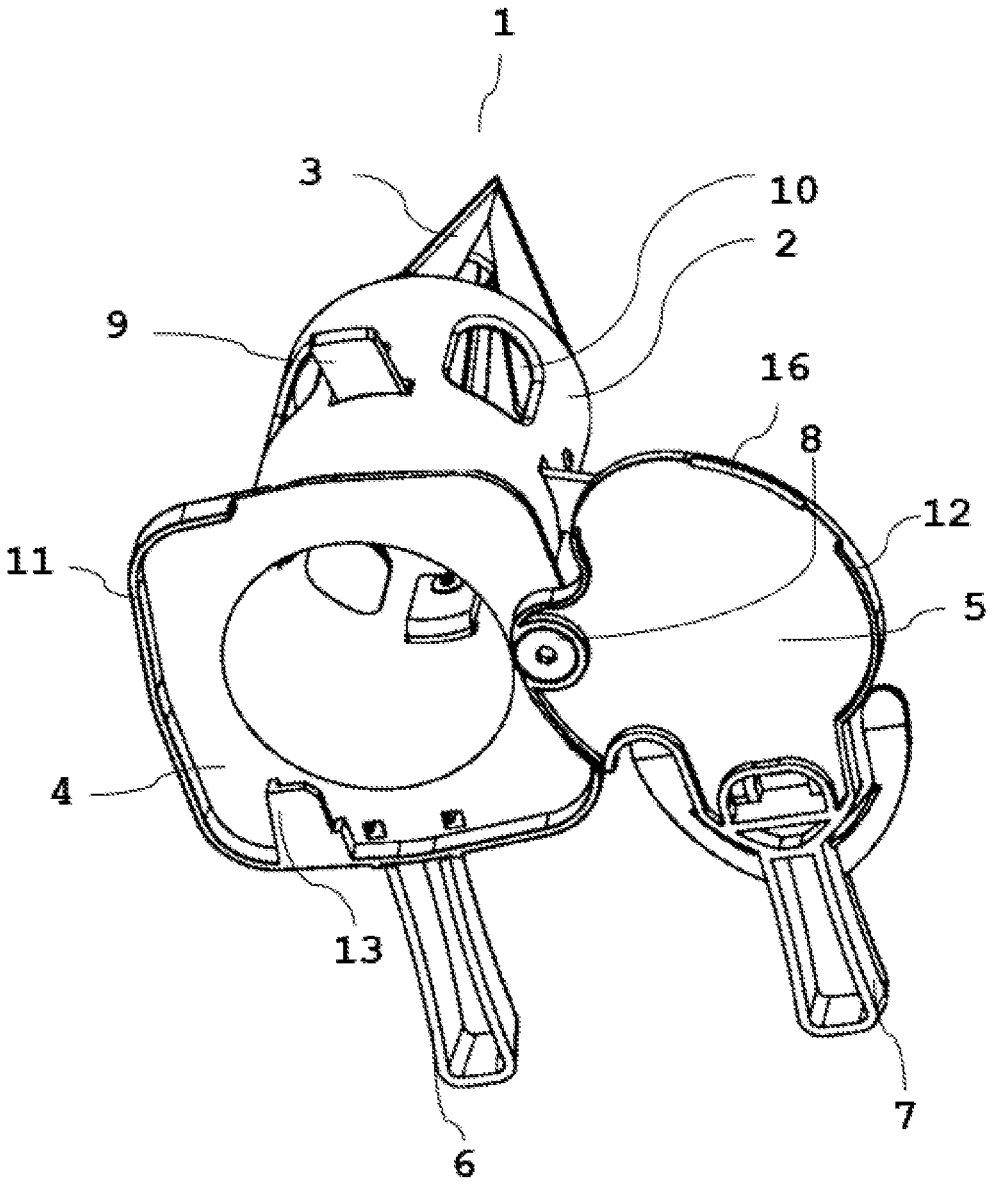
FIG. 3: shows the filling mandrel according to the invention in a perspective view from diagonally below with a closed closure.
Figure 4:
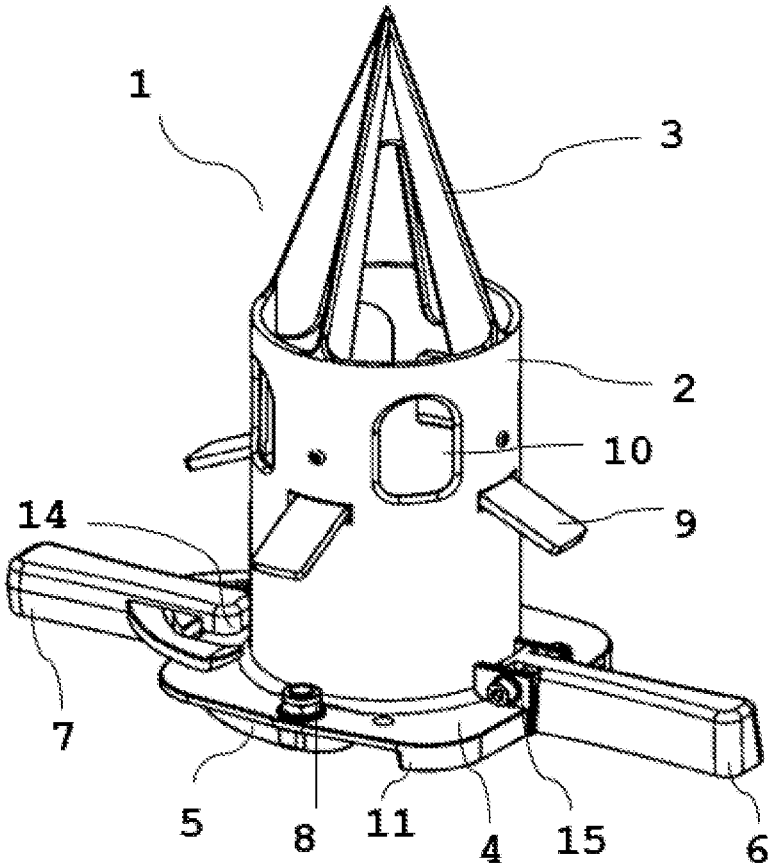
FIG. 4: shows the filling mandrel according to the invention in a perspective view from diagonally above with a closed closure.

To make the lower opening of the hollow body 2 or of the upper plate 4 closable, a pivotable lower plate 5 is provided. The upper plate 4 is provided with a handle 6 and the lower plate 5 is provided with a handle 7, which are preferably diametrically opposed in the closed state of the closure. The upper plate 4 and the lower plate 5 each comprise a hole, through which the bolt 8 passes, wherein the bolt 8 is pivotably held in at least one of these holes. The lower plate 5 can be pivoted about the axis of the bolt 8, in order to open the opening of the hollow body 2 downwardly, as can be seen in FIG. 3.

Figure 5:
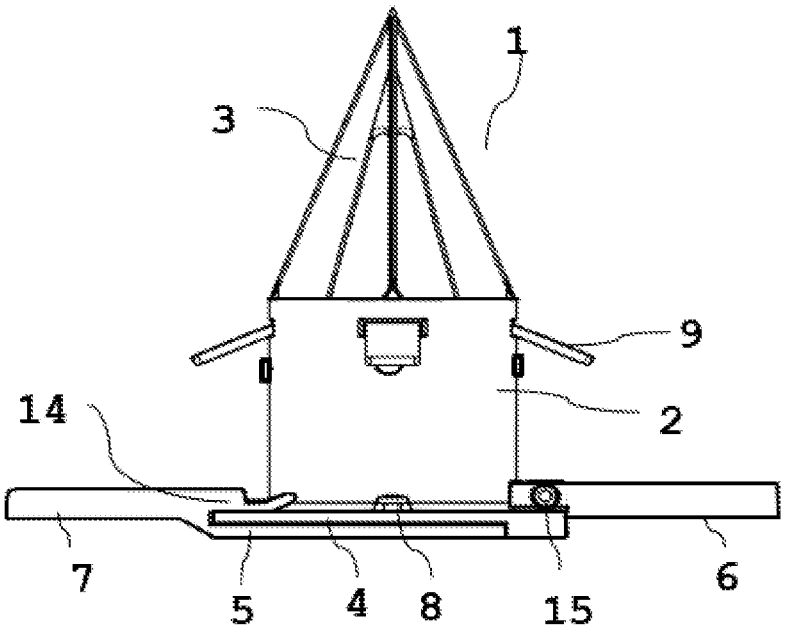
FIG. 5: shows a second embodiment according to the invention in a front view.

Between the struts 3 and the upper plate 4, the hollow body 2 has outer barbs 9, which consist of resilient material, such that said barbs are pressed downwards onto the hollow body 2 during piercing through the fabric of the big bag so as to not enlarge the opening in the fabric. If the barbs 9 move completely through the fabric, they return to their starting position and splay out against the inner side of the fabric when retracting. Slightly above the barbs 9, openings 10 are present in the lateral surface of the hollow body 2, in order to facilitate virtually complete emptying of the big bag. Alternatively, it would also be possible to attach the barbs 9 further up on the hollow body 2, in order to forego the openings 10, as can be seen in the alternative embodiment of FIG. 5. The barbs 9, known in prior art, are provided as strips of flexible resilient material and are guided inwards through slots in the hollow body 2 and fixed above the slots on the inner side of the hollow body 2 by rivets. Relatively solid rubber is suitable as the material. According to the invention, the barbs 9 can be designed, according to FIG. 5, as spring steel strips which feature a bend with a sharp angle and are fixed below the slots on the inner side of the hollow body 2 by rivets or screws, whereby the distance between the barbs 9 and the upper opening surface of the hollow body can be reduced to enable the device to be produced more simply, more compactly and therefore in a material-saving and more cost-effective manner.

The fundamental improvement according to the invention relates to the closure or the base surface of the filling mandrel 1. According to the invention, the upper plate 4 should be provided with a structure 11 which forms a part of the base of the filling mandrel 1. Likewise, according to the invention the lower plate 5 should be provided with a structure 12 which also forms a part of the base of the filling mandrel 1. The head of the bolt 8 projects maximally as far as to the base and is preferably received in a groove of the structure 12. As can be seen particularly clearly in FIG. 3, it is sufficient to implement the structures 11 and 12 as webs on the edge of the respective plate 4, 5. Alternatively, in the case of the lower plate 5, virtually the entire surface can be provided with the structure 12, with the exception of the groove for the head of the bolt 8 and one groove per locking projection 13 for the locking. The structure 11 is arranged on the upper plate 4 such as to not affect the pivoting movement of the upper plate 4. The perimeter of the upper plate 4 is designed for this reason to be greater than that of the lower plate 5. Particularly good stability is produced when the base formed by the structures 11 and 12 has an approximately square perimeter. The undersides of the handles 6, 7 can form a level surface with the base, i.e. connect to the structures 11, 12 in a coplanar manner. As seen in the alternative embodiment of FIG. 5, the undersides of the handles 6, 7 can also be spaced from the base upwards.

According to the invention, the closure has a locking projection 13, which is part of the upper plate 4, or is fixed to the same. The locking projection 13 is attached such as to hold the lower plate 5 against the upper plate 4 when the closure is closed. The locking projection 13 has a plate-shaped segment for this purpose, the upper surface of which is separate to the upper plate 4 and the lower surface of which is preferably coplanar with the base or the structure 11. When closing, the lower plate 5 reaches with its edge region into the gap between the locking projection 13 and the upper plate 4 and preferably has in this edge region a chamfer 16 or rounding. The locking projection 13 is preferably located, in relation to the lower opening of the hollow body 2, approximately diametrically opposite the bolt 8. In the case that the upper plate 4 has two locking projections 13, these preferably form, in relation to the lower opening of the hollow body 2, an angle of about 120° respectively to each other and to the bolt 8. In the depicted embodiments of FIGS. 1-4, a locking projection 13 is provided, which is at an angle of approximately 135° to the bolt 8 and an angle of approximately 135° to the handle 7, as the handle 7 or the lower plate 5 in the region of the handle 7 also has a locking projection 14, which overlaps the upper plate 4 in the closed state. The handle 7 is at an angle of approximately 90° to the bolt 8. This locking projection 14 can be omitted if, in this region or as previously mentioned at an angle of 120° to the bolt 8, a second locking projection 13 is provided on the upper plate 4.

As the lower plate 5 is held against the upper panel 4 at three points, consisting of the bolt 8, the locking projection 13 and the locking projection 14 (or a second locking projection 13), in the closed state, stable and reliable closure of the filling mandrel 1 is produced.

A further improvement according to the invention is that at least one of the handles 6, 7, preferably the handle 6, should be fixed in a folding manner. As shown, the handle 6 is pivotably fixed by means of a bolt 15 between two parallel lugs in the transition region between the upper plate 4 and the hollow body 2. The handle 6 can rest on the upper plate 4 in the lower position and be upwardly pivotable against the weight force or against a spring force, for example a hinge spring. The handle 6 can alternatively be engaged in the lower position and pressed upwardly out of this position with some resistance. The folding mechanism prevents the handle 6 from breaking upon exertion of excessive strain.

The handle 7 can be fixed accordingly to the lower plate 5. However, preferably the handle 7 and the lower plate 5 are produced as monolithic plastics bodies using the injection moulding procedure.

Figure 6:
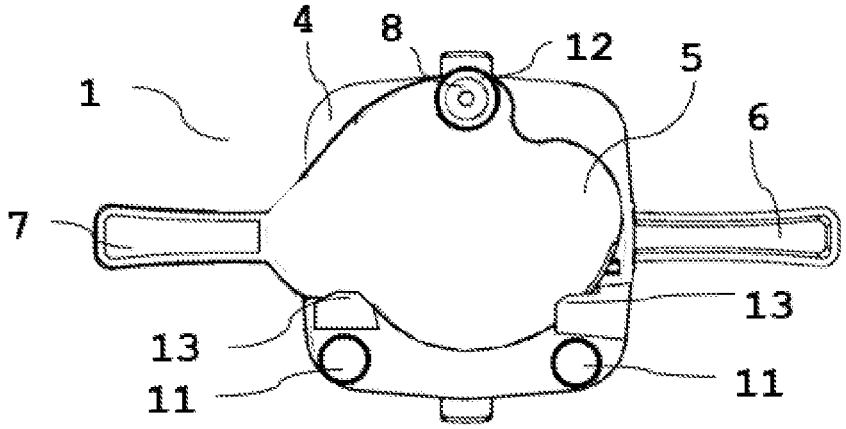
FIG. 6: shows a third embodiment according to the invention in a view from below.
Figure 7:
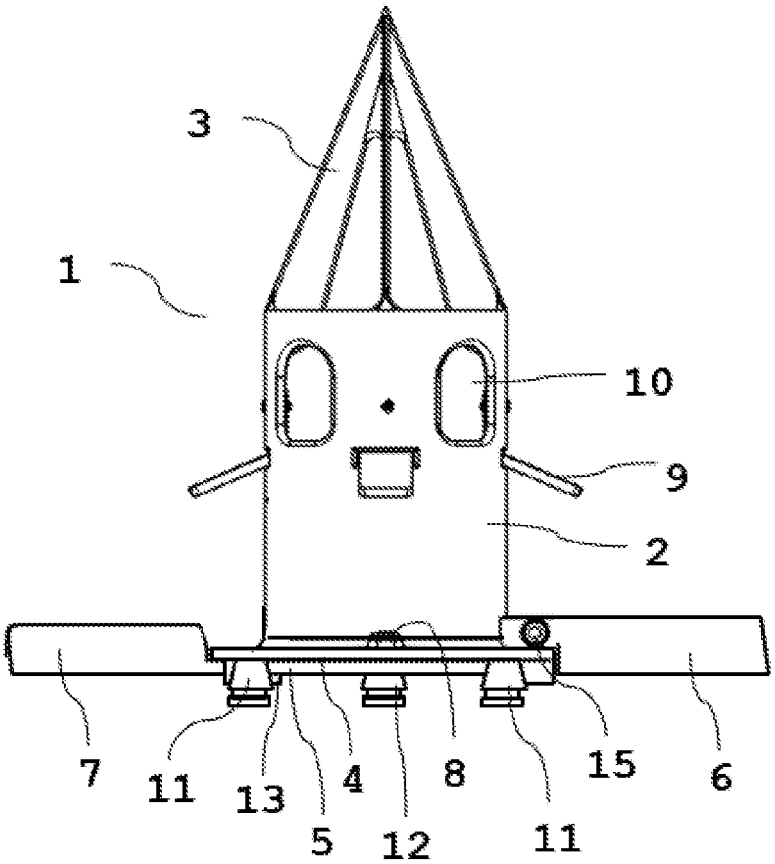
FIG. 7: shows the third embodiment according to the invention in a front view.
Figure 8:
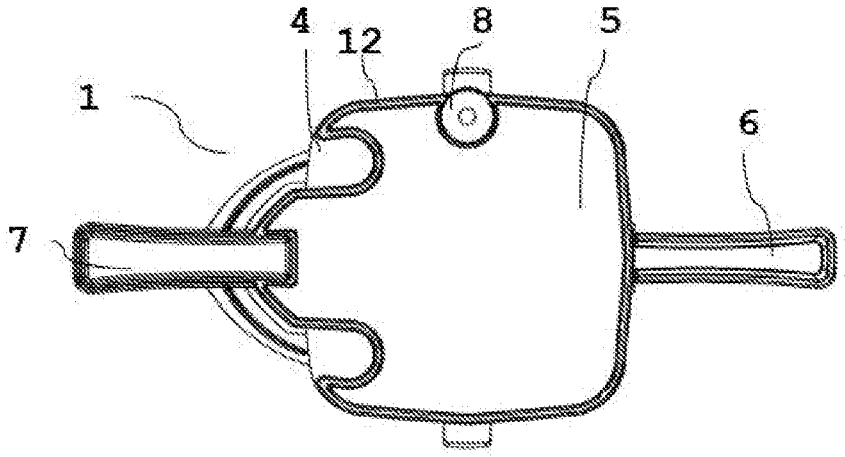
FIG. 8: shows a fourth variation of the filling device according to the invention in a view from below with a closed closure.
Figure 9:
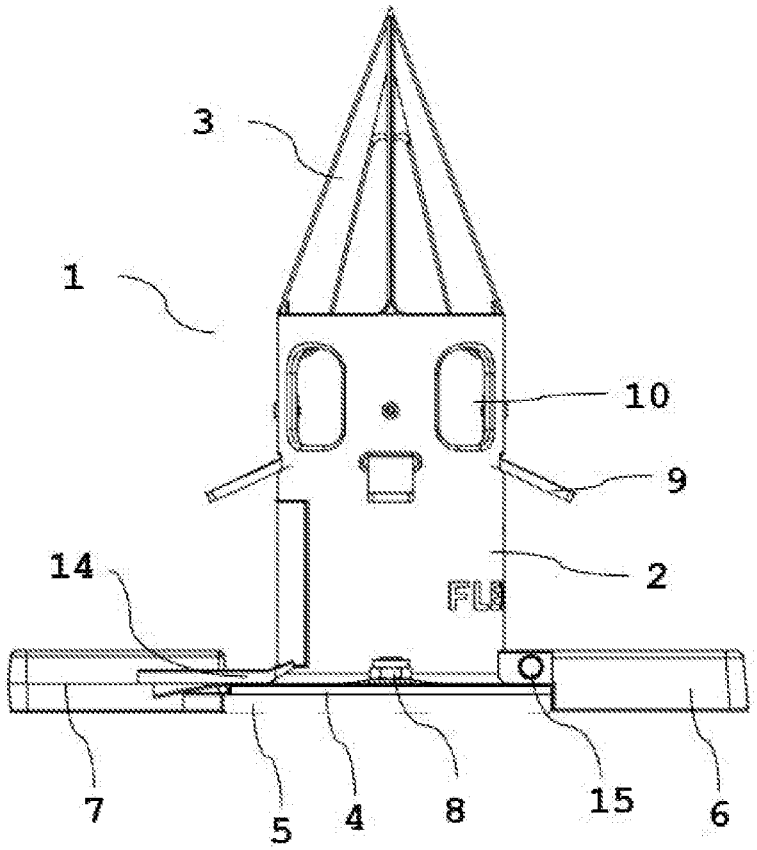
FIG. 9: shows the fourth variation of the filling device according to the invention in a front view with a closed closure.

The upper and lower discs 4, 5 are preferably provided with the respective structure 11, 12 during the injection moulding procedure. Less preferably, the structure 11, 12, particularly the structure 11, can be retrospectively attached, for example screwed, nailed, riveted or bonded to the plate 4, 5 in the form of a number of feet. A foot can for example be secured by the bolt 8 to the lower plate 5, or can be part of the head of the bolt 8. As can be seen in FIGS. 6 and 7, the structures 11 and 12 can be attached in the form of three feet to form a tripod or be produced in the injection moulding procedure, wherein the lower surfaces of the three feet form the base of the filling mandrel 1. The grooves shown in the feet can be used to connect a fabric hose or woven hose or a sack by means of a spring hose clamp. The hose or the sack preferably has a seam around its opening, into which the spring hose clamp or a similar slotted wire hoop is sewn. Particularly preferably, a short fabric hose section to which a filling tube connects can be quickly fixed in this way, whereby the filling tube can be advantageously pivoted independently of filling mandrel 1 due to the flexible fabric section. The feet can also have threads, to which an attachment or a filling nozzle can be screwed.

The claimed technical features according to the invention of the described embodiments can be combined in any manner as part of the activities of a person skilled in the art. The claimed scope of protection is based solely on the combination of features defined in the independent claim.

FIGS. 8 to 11 all show the same particularly preferable filling mandrel 1 according to the invention. The filling mandrel 1 features a hollow body 2, which preferably has a cylindrical jacket. On the upper end of the hollow body 2, a number of struts 3 merge into a tip. At the lower end, the hollow body 2 merges into the upper plate 4, which connects to the cylinder on the outside and preferably leaves the inner opening of the hollow body 2 entirely open. The hollow body 2, the upper plate 4 and the struts 3 forming the tip are preferably produced as monolithic plastics bodies using the injection moulding procedure.

Figure 10:
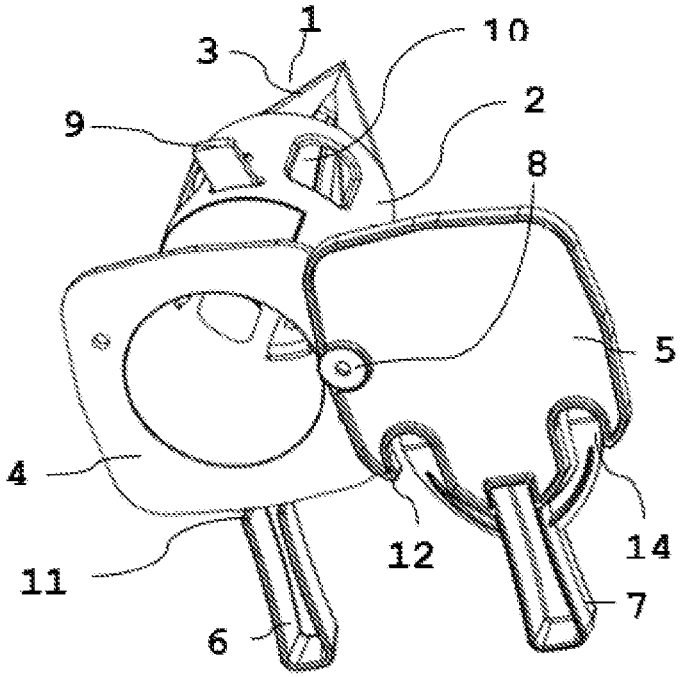
FIG. 10: shows the fourth variation of the filling device according to the invention in a perspective view from diagonally below with an opened closure.
Figure 11:
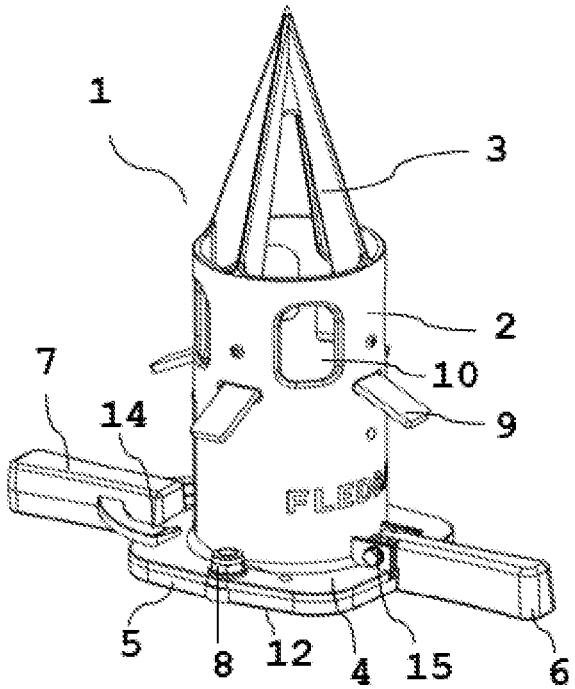
FIG. 11: shows the fourth variation of the filling device according to the invention in a perspective view from diagonally above with a closed closure.

To make the lower opening of the hollow body 2 or of the upper plate 4 closable, a pivotable lower plate 5 is provided. The upper plate 4 is provided with a handle 6 and the lower plate 5 is provided with a handle 7, which are preferably diametrically opposed in the closed state of the closure. The upper plate 4 and the lower plate 5 each comprise a hole, through which the bolt 8 passes, wherein the bolt 8 is pivotably held in at least one of these holes. The lower plate 5 can be pivoted about the axis of the bolt 8, in order to open the opening of the hollow body 2 downwardly, as can be seen in FIG. 10.

The fundamental improvement according to the invention relates to the closure or the base surface of the filling mandrel 1. According to the invention, the lower plate 5 should be provided with a structure 12 which forms at least a part of the base of the filling mandrel 1. The head of the bolt 8 projects maximally as far as to the base and is preferably received in a groove of the structure 12. As can be seen particularly clearly in FIG. 10, it is sufficient to implement the structure 12 as webs on the edge of the lower plate 5. Alternatively, in the case of the lower plate 5, virtually the entire surface can be provided with the structure 12, with the exception of the groove for the head of the bolt 8. Particularly good stability is produced when the base formed by the structure 12 has an approximately square perimeter. As can be seen in FIG. 10, the structure 11 can be provided on the handle 6 of the upper plate 4, such that the handle 6 of the upper plate 4 forms a part of the base, wherein, in the event of strong leverage (for example when the bulk material container is set down at an angle or swings when being set down), said handle folds upwards by means of the hinged joint before it can be broken. If the handle 6 were monolithically connected to the hollow body 2, then the entire injection moulded part would also have to be disadvantageously replaced when the handle 6 breaks. In one embodiment, the structure 11 on the handle 6 can extend beyond the lower plate 5 in the closed state, wherein in this case the lower plate 5 has no structure 12 in the region of the structure 11, overlapping the disc, of the handle 6 or can comprise a chamfer 16 or rounding, whereby the structure 11 on the handle 6 forms a locking projection 13 for the lower plate 5. In the process, the structure 11 or the locking projection 13 of the handle 6 is preferably designed such that the upwards folding of the handle 6 is not restricted, for example the structure 11 can have a rounding on its edge facing the ground.

As can be seen in FIGS. 8 to 11, the locking projection 14 is preferably designed in two parts, wherein the two parts of the locking projection 14 protrude laterally from the handle 7 and each overlap the upper plate 4 laterally from the handle 7 in a manner spaced apart from each other. In the region of the two parts of the locking projection 14, the lower plate 5 preferably has a corresponding groove, such that the closing of the filling mandrel 1 works easily and reliably. The upper plate 4 preferably has an at least approximately rectangular or preferably square perimeter, wherein the lower plate 5 in the closed state covers at least the opening of the upper plate 4 and the corner regions of the at least approximately square perimeter and is provided, at least in these corner regions, with a structure 12 which forms the base and/or four support legs of the filling mandrel 1. By designing the base as a polygon, in particular as a triangle or quadrilateral, there is a significant improvement compared with round or circular bases. The depicted perimeter with rounded corners, in which the lateral edges of the square are also outwardly curved, should in particular also be understood as an approximately square perimeter. More generally, the base of the filling mandrel 1 or the shape of the structure 12 has a non-circular shape.

By means of the structure 12 extending around the periphery, the stiffness or the bending resistance of the lower plate 5 is increased, such that any deflection of the lower plate 5 is prevented.

Figure 12:
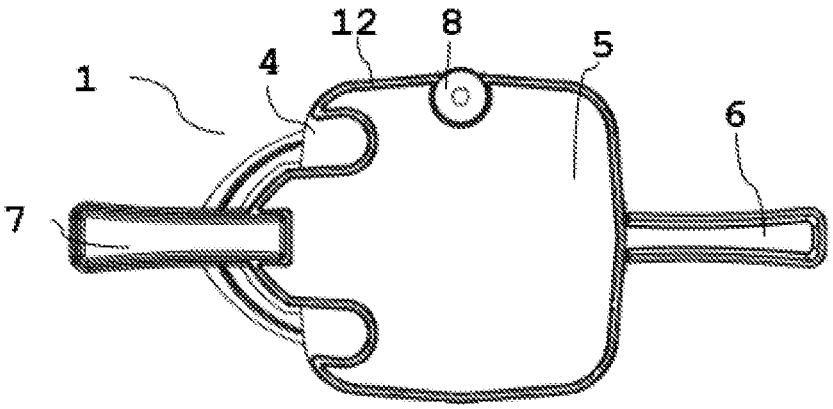
FIG. 12: shows a fifth variation of the filling device according to the invention in a view from below with a closed closure.
Figure 13:
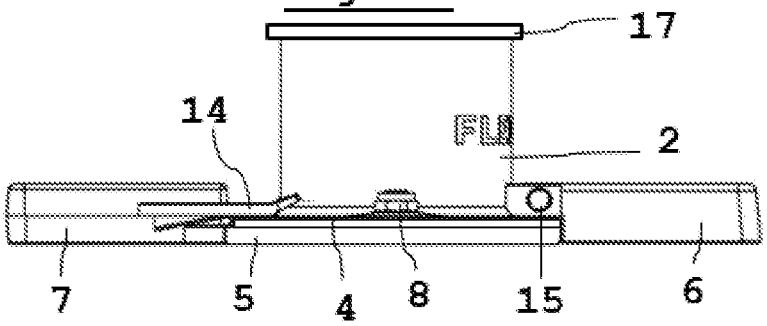
FIG. 13: shows a fifth variation of the filling device according to the invention in a front view with a closed closure.

In FIGS. 12 and 13, a further embodiment of a filling device according to the invention is shown, in which no struts 3, no barbs 9 and no openings 10 are provided on the hollow body 2. The hollow body 2 has a projection 17, which extends around the circumference of the hollow body 2, i.e. is formed by a rapid enlargement of the outer circumference of the hollow body 2. The projection 17 is preferably located directly at the upper end of the hollow body 2. The other present parts of the device, namely the upper plate 4, lower plate 5, the preferably foldable handle 6, the handle 7, the bolt 8 and the structure 12, can be designed identically to the previous embodiment, as shown. The embodiment according to the invention of FIGS. 12 to 13, in contrast to the filling mandrel 1, is not pierced through the casing of the bulk material container, but rather is placed in the closable opening of a flexible reusable bulk material container 18.

Figure 14:
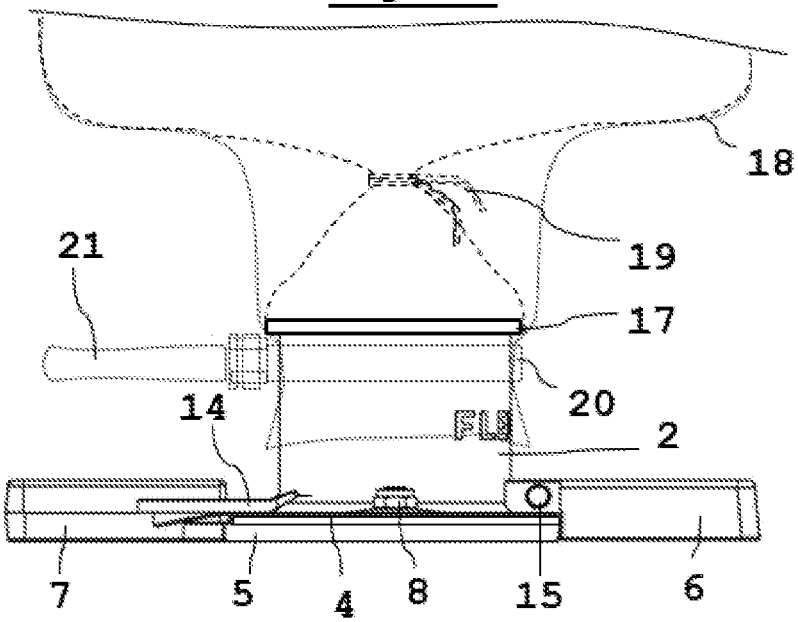
FIG. 14: illustrates the attachment of the fifth variation of the filling device according to the invention to a flexible, reusable bulk material container.

The connection of a reusable bulk material container 18 to the filling device according to the invention is illustrated in FIG. 14. The reusable bulk material container 18 has on its lower end an open end, which is usually provided with a smaller cross section than the region thereabove of the reusable bulk material container 18. Shown with dotted lines, the open end is closed, for example bound by a band 19.

To empty the reusable bulk material container 18, the band 19 is opened and the bulk material escapes through the open end.

The filling device according to the invention can be used to empty the content of the reusable bulk material container 18 in a metered way. For this purpose, with the reusable bulk material container 18 still closed, the hollow body 2 is inserted beneath the band 19 into the open end, whereby said end is fixed outside on the hollow body 2, preferably by a pipe clamp or a clamping ring 20, which is shown as dotted in FIG. 14. The clamping ring 20 can advantageously be closed or opened using a lever 21, in order to facilitate the attachment and detachment without the need for tools.

If the clamping ring 20 is closed, this fixes the fabric of the open end of the reusable bulk material container 18 against the hollow body 2 from the outside, wherein the projection 17 prevents the clamping ring 20 from slipping from the hollow body 2. In this state, the band 19 can be detached, such that the bulk material of the opened reusable bulk material container 18 (shown as dotted) passes through the hollow body 2 to the lower plate 5 and rests against said plate. By pivoting the lower plate 5 about the bolt 8, the filling device according to the invention can be opened and material can be removed in a metered manner from the reusable bulk material container 18. An advantage compared to known transportable manual metering devices for removal of material from a reusable bulk material container 18 is that the filling device according to the invention has improved stability and preferably at least one foldable handle 6, such that a full or partially emptied reusable bulk material container 18 together with the filling device according to the invention can be set on the ground without risking any damage to the filling device. This is particularly advantageous for agricultural operations, as the reusable bulk material container 18, for example big bags, are normally lifted with a forklift truck or front loader, wherein after setting down the big bag together with the filling device according to the invention the forklift truck or front loader is immediately available for other tasks. Complex removal of the metering devices from full or partially emptied big bags can be omitted in this way.

The invention claimed is:

1. A filling device for removing material from a flexible bulk material container, comprising:

a hollow body;

an upper plate;

a lower plate; and a bolt;

wherein said hollow body includes an upper and a lower opening surface, wherein an upper end of the hollow body is configured to protrude into an interior of the flexible bulk material container, such that material is able to exit the flexible bulk material container and penetrate the hollow body through the upper opening surface thereof, wherein at a lower end of the hollow body a closure is provided comprising said upper plate and said lower plate lying flatly against each other, wherein the upper plate connects to the lower opening surface of the hollow body and the upper plate includes an opening in an extension of the lower opening surface of the hollow body, wherein the lower plate is fixed by said bolt to the upper plate and the lower plate is configured to be pivoted about an axis of said bolt, between a first position, in which said lower plate completely closes the opening of the upper plate, and a second position, in which the opening of the upper plate is at least partially opened, wherein the lower plate includes a structure which forms at least a part of a base of the filling device, and wherein the bolt does not protrude downwards from the base.

2. The filling device according to claim 1, wherein:

the upper plate has an at least approximately square perimeter, wherein, in a closed state of the filling device, the lower plate covers at least the lower opening surface of the upper plate and corner regions of the at least approximately square perimeter, and the lower plate is provided, at least in the corner regions, with at least one of said structure which forms the base and four support legs of the filling device.

3. The filling device according to claim 1, wherein:

a handle is attached to the upper plate and a handle is attached to the lower plate, said handles each extending approximately horizontally from the respective plate, and a lower surface of each handle does not protrude downwards beyond the base of the filling device.

4. The filling device according to claim 3, wherein at least one of the handles is pivotably fixed to the respective plate and can be folded upwards.

5. The filling device according to claim 3, wherein the lower plate or the handle of the lower plate features at least one locking projection, which protrudes over the upper surface of the upper plate in a position in which the lower plate completely closes the opening of the upper plate.

6. The filling device according to claim 3, wherein the upper plate or the handle of the upper plate features at least one locking projection, which is positioned at a distance to a contact surface of the upper plate for the lower plate and in a position in which the lower plate completely closes the opening of the upper plate, the lower plate is held with at least one edge region in a gap between the contact surface to of the upper plate and the at least one locking projection.

7. The filling device according to claim 1, wherein the structure comprises at least one web along at least one partial perimeter of the lower plate.

8. The filling device according to claim 1, wherein a head of the bolt is received in the structure of the lower plate.

9. The filling device according to claim 1, wherein:

a tip connects to the upper end of the hollow body, said tip can penetrate the flexible bulk material container through a casing thereof and leaves the upper opening surface of the hollow body at least partially open, distanced from the lower end, barbs protrude from a jacket of the hollow body and hold the filling device in the flexible bulk material container after penetration of the flexible bulk material container, and the hollow body, the tip and the upper plate are a monolithic plastics injection molded part.

10. The filling device according to claim 3, wherein the lower plate and the handle of the lower plate are a monolithic plastics injection molded part.

11. A filling device for removing material from a flexible bulk material container, wherein the filling device comprises:

a hollow body;

an upper plate;

a lower plate; and a bolt;

wherein said hollow body, having an upper and a lower opening surface, wherein an upper end of the hollow body protrudes into an interior of the flexible bulk material container, such that material can exit the flexible bulk material container and penetrate the hollow body through the upper opening surface thereof, wherein at the lower end of the hollow body a closure is provided featuring said upper plate and said lower plate lying flatly against each other, wherein the upper plate connects to the lower opening surface of the hollow body and the upper plate includes an opening in an extension of the lower opening surface of the hollow body, wherein the lower plate is fixed by said bolt to the upper plate and the lower plate can be pivoted about an axis of said bolt, between a first position, in which the lower plate completely closes the opening of the upper plate, and a second position, in which the opening of the upper plate is at least partially opened, wherein a first handle is attached to the upper plate and a second handle is attached to the lower plate, said first and second handles each extending approximately horizontally from the respective plate, wherein the lower surface of each handle does not protrude downwards beyond a base of the filling device, and wherein at least one of the handles is pivotably fixed to the respective plate and can be folded upwards.

12. The filling device according to claim 11, wherein:

the lower plate features a structure which forms at least a part of the base of the filling device, and the bolt does not protrude downwards from the base.

13. The filling device according to claim 12, wherein:

the upper plate has an at least approximately square perimeter, in the closed state of the filling device, the lower plate covers at least the lower opening surface of the upper plate and corner regions of the at least approximately square perimeter, and the lower plate is provided, at least in the corner regions, with at least one of said structure which forms the base and four support legs of the filling device.

14. The filling device according to claim 13, wherein the structure comprises at least one web along at least a partial perimeter of the lower plate.

15. The filling device according to claim 11, wherein:

a tip connects to the upper end of the hollow body, said tip can penetrate the flexible bulk material container through a casing thereof and leaves the upper opening surface of the hollow body at least partially open, distanced from a lower end, barbs protrude from a jacket of the hollow body and hold the filling device in the flexible bulk material container after penetration of the flexible bulk material container, and the hollow body, the tip and the upper plate are a monolithic plastics injection molded part.

16. The filling device according to claim 11, wherein the lower plate and the second handle are a monolithic plastics injection molded part.

17. A filling device for removing material from a flexible bulk material container, wherein the filling device comprises:

a hollow body;

an upper plate;

a lower plate; and a bolt;

wherein said hollow body, having an upper and a lower opening surface, wherein an upper end of the hollow body protrudes into the interior of the flexible bulk material container, such that material can exit the flexible bulk material container and penetrate the hollow body through the upper opening surface thereof, wherein at the lower end of the hollow body a closure is provided featuring said upper plate and said lower plate lying flatly against each other, wherein the upper plate connects to the lower opening surface of the hollow body and the upper plate comprises an opening in an extension of the lower opening surface of the hollow body, wherein the lower plate is fixed by said bolt to the upper plate and the lower plate can be pivoted about an axis of said bolt, between a first position, in which the lower plate completely closes the opening of the upper plate, and a second position, in which the opening of the upper plate is at least partially opened, wherein the upper plate has an at least approximately square perimeter, wherein, in the closed state of the filling device, the lower plate covers at least the lower opening surface of the upper plate and corner regions of the at least approximately square perimeter, and wherein the lower plate is provided, at least in the corner regions, with at least one of a structure which forms a base and four support legs of the filling device.

18. The filling device according to claim 17, wherein the bolt does not protrude downwards from said structure.

19. The filling device according to claim 17, wherein a first handle is attached to the upper plate and a second handle is attached to the lower plate, said first and second handles each extending approximately horizontally from the respective plate, wherein the lower surface of each handle does not protrude downwards beyond the base of the filling device.

20. The filling device according to claim 19, wherein the lower plate and the second handle are a monolithic plastics injection molded part and wherein the hollow body and the upper plate are a monolithic plastics injection molded part.

* * * * *